United States Patent [19]

Jørgensen

[11] Patent Number: 4,637,327

[45] Date of Patent: Jan. 20, 1987

[54] STOKING PLANT FOR FUEL IN WHOLE BALES

[75] Inventor: Michael L. S. Jørgensen, Aarhus, Denmark

[73] Assignee: Jydsk Varmekedelfabrik A/S, Braband, Denmark

[21] Appl. No.: 821,244

[22] Filed: Jan. 22, 1986

[51] Int. Cl.[4] ..... F23K 3/12

[52] U.S. Cl. ..... 110/289; 110/101 C; 110/109; 110/196; 110/327; 414/173; 414/181

[58] Field of Search ..... 110/193, 196, 197, 235, 110/267, 286, 289, 290, 327, 101 R, 101 C, 101 CF, 109, 101 A, 210; 414/173, 180, 181, 222, 417

[56] References Cited

U.S. PATENT DOCUMENTS

| | | | |
|---|---|---|---|
| 457,063 | 8/1891 | Ward | 414/173 |
| 908,747 | 1/1909 | Clouston | 110/196 |
| 2,765,934 | 10/1956 | Wright et al. | 414/181 |
| 3,877,589 | 4/1975 | Stockman | 110/109 X |
| 3,986,624 | 10/1976 | Cates, Jr. et al. | 414/173 |
| 4,231,302 | 11/1980 | Linneborn | 110/210 X |
| 4,315,712 | 2/1982 | Seglias | 414/173 X |

FOREIGN PATENT DOCUMENTS

| | | | |
|---|---|---|---|
| 2325819 | 12/1974 | Fed. Rep. of Germany . | |
| 2501255 | 7/1975 | Fed. Rep. of Germany | 110/196 |
| 2492504 | 4/1982 | France | 110/193 |

*Primary Examiner*—Albert J. Makay
*Assistant Examiner*—Steven E. Warner
*Attorney, Agent, or Firm*—Merchant, Gould, Smith, Edell, Welter & Schmidt

[57] ABSTRACT

A stoking plant for fuel in whole bales, where the bales are conveyed on a transport tract (8) from a store and stoked in the whole condition into one of a number of combustion furnaces (2) with boilers (1), comprises a slide-gate (10) through which a bale transport carriage (5) can be filled with a bale of fuel. The transport carriage (5) then conveys the bale forward to the furnace (2) which is in need of fuel. When the bale transport carriage is positioned opposite the stoking door (4) of the furnace, a cover door (6) is released which is pressed against the carriage (5) by springs (13), a switch element is activated and the stoking door (4) is opened, and the bale is pushed into the furnace (2) by a piston (7). The piston (7) is withdrawn, but in such a manner that the furnace door (4) is closed before the cover door (6) is withdrawn to the start position. The bale transport carriage (5) is a tubular carriage which travels on running rails (9). The stoking plant thus achieved is one with which the sucking-in of large amounts of uncontrolled air is completely avoided, even when the fuel being stoked is in whole bales.

6 Claims, 3 Drawing Figures

STOKING PLANT FOR FUEL IN WHOLE BALES

Figure 1:
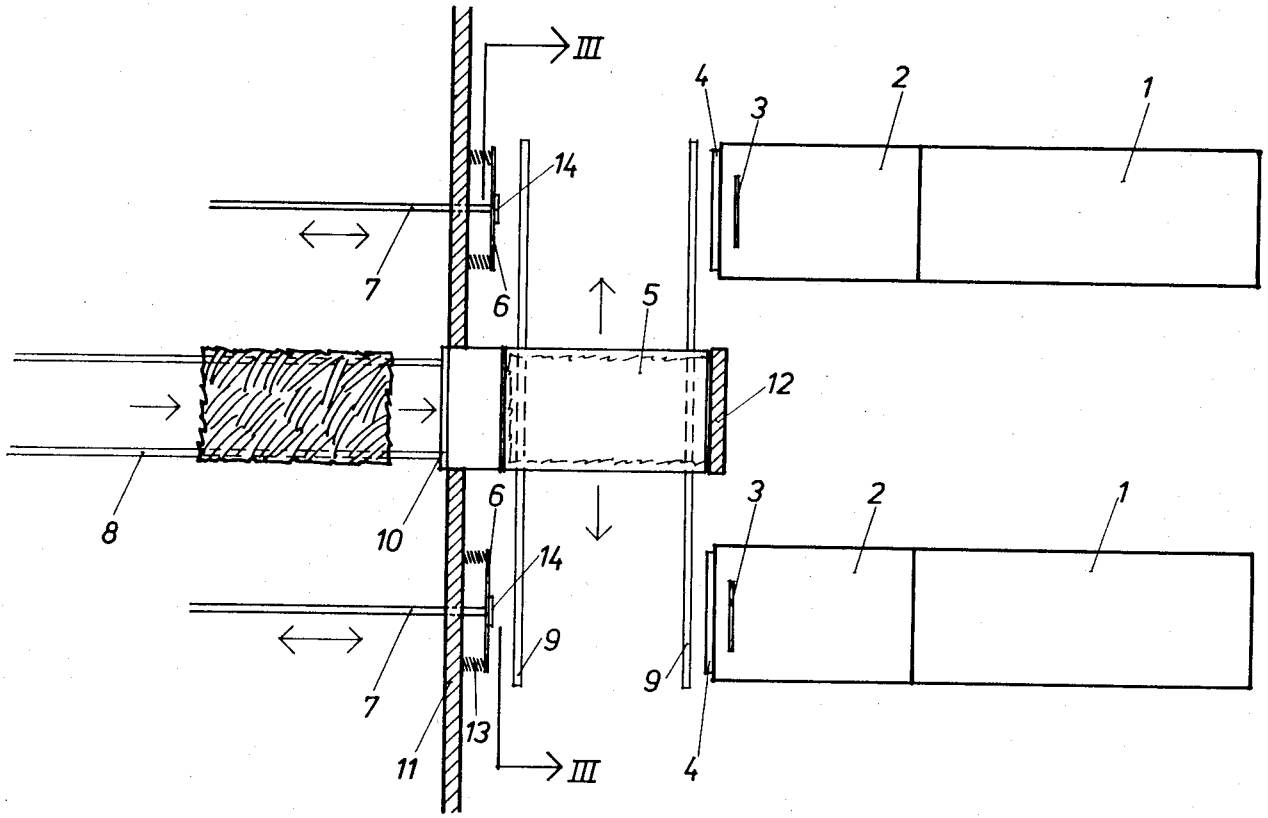

The invention relates to a stoking plant for fuel in whole bales, where the bales are transported on a conveyor from a store and stoked in the whole condition into one of a number of combustion furnaces.

For many years, the high energy prices for fossilized fuels and the high calorific value of many waste materials or by-products such as straw, paper, bark, olive shells and the like, have made it attractive to produce stoking plants for combustion boilers for solid fuel, whereby such fuel can be stoked in whole bales. However, in connection with the stoking of fuel in whole bales, there are many problems which must be given careful consideration if one is to produce a plant which is efficient from the point of view of combustion technique. A considerable disadvantage with the stoking of whole bales is the large and uncontrolled amount of air which is sucked in while the stoking door is open and the bale is being stoked, i.e. the $O_2$% increases and the temperature is reduced during the stoking of the bale, and an increased combustion of the stoked bale is established until the stoking door is closed again. Also, the high $O_2$% falls drastically, for example to 0.5%, with unburned gases as a consequence, shortly after the stoking door is closed. It is known that one can throttle down the combustion-air blower during the stoking of a bale, and similarly to reduce the negative pressure in the furnace by means of an exhaust gas damper or the like while stoking is taking place. The disadvantage here, however, is that the combustion is reduced almost as much below the ideal point, as it is increased above this point in the previous case when no down-throttling of the combustion air is effected, and the result is a greatly varying performance from the furnace.

From U.S. Pat. No. 908,747, a plant is known for the combustion of bales of straw, where the bales are fed individually to the furnace by means of an endless chain conveyor in a metal housing. At a suitable point in the downwards course of the conveyor, a side opening is provided through which the bales to be burned are introduced singly, this being inserted in a metal casing which is open at the ends and which has a throughgoing slot extending horizontally along the centreline of its one side wall. The casing with the straw bale is introduced in such a manner that this slot faces towards the side of the endless conveyor. At a suitable point in the upwards course of the conveyor, in its side wall there is provided another opening which with a quadrangular tube, the inside dimensions of which correspond to the section of the straw bale, is connected to a combustion chamber.

The bales of straw are introduced singly into the combustion chamber through the quadrangular tube by means of a conveyor consisting of an endless, horizontally-disposed single chain which is provided with an extending tongue. This conveyor with tongue is designed to engage through a slot running horizontally in the outer wall of the conveyor and the slot in the casing, and thus with the straw bale which, during the intermittent movement of the endless conveyor, is brought opposite the tube to the combustion chamber. Since the opening and/or the tube through which the bales are forced by the conveyor into the combustion chamber corresponds precisely to the section of the bale, the holder remains in the conveyor.

In order for such a plant to be able to function, it is necessary for the intermittent movement of the endless conveyor chain and the movement of the conveyor to be in precise accordance with each other, and moreover moved at such a speed that the bale which is introduced into the tube at any given time, even though it is partly burned, forms a plug which prevents flames from the combustion chamber from entering the endless conveyor. Consequently, it is a condition that the part of the endless conveyor extending between the stoking door and the ejection opening is always filled with bales of straw.

From German publication No. 2,325,819, a plant is known for the burning of waste, which is also used for the burning of straw bales. Between the material supply point and the underlying combustion chamber, a horizontally-movable gate is provided. The supply of material is effected either by means of a rotary conveyor with a number of tubular chambers, or by a chain conveyor mounted horizontally in a housing, which by means of plates extending from the chains is divided into chambers. When used for the burning of bales of straw, each bale is placed in its tubular chamber or respectively its chamber formed between two consecutive plates. The supply of bales to this plant is not so simple, and will give rise to problems with regard to both stable operation and danger of fire.

A feeding system for the stoking of whole bales into a furnace is known from Danish patent No. 143,471. The whole bales of straw are fed intermittently forward on a conveyor which is characteristic in that between the conveyor and the furnace, a chute is provided which inclines downwards towards the furnace's vertically-arranged slide gate, and that on the chute there is a sensor coupled to the slide-gate moving means and the conveyor's driving means in such a manner that said sensor, each time it is moved by a bale delivered from the conveyor, results in the bale conveyor being stopped and that the slide gate is opened after a short delay. When the slide gate is fully open, the bale of straw is pressed into the furnace by means of an activated ram, and when the bale is completely inside the furnace, the ram is activated for withdrawal. As soon as the ram is outside the slide gate, the gate closes the stoking opening.

The system known herefrom is fireproof and is functionally excellent, but it has the disadvantage that during the stoking of a bale, just as great an amount of uncontrolled air is sucked in, and which intensifies the combustion at the point at which the development of gas is at its greatest, and also that this system demands the use of a conveyor with chute etc. for each furnace. Moreover, there is also a certain risk of burning straw falling out into the chute when the ram is withdrawn.

The object of the invention according to the present application is to provide a stoking plant of the said kind which affords not only safe fire conditions, but also one with which the sucking-in of large amounts of uncontrolled air is completely avoided, even when the fuel being stoked is in whole bales.

This is achieved by constructing the plant according to the invention as presented and characterized in claim 1. With this plant, the store for the fuel can be separated completely from the furnace room in such a manner that the whole store is situated behind a fireproof wall, and that the amount of fuel to be found in the furnace room consists only of that which is on its way to the furnace, e.g. one bale. Further fuel cannot be fed into the furnace room before the amount of fuel in the bale transport carriage has been delivered to a furnace, the furnace door has been closed again and the bale transport carriage returned to its start position. The actual stoking is effected completely without possibility of false air being sucked in, the result being a well-controlled and uniform combustion of the stoked fuel.

If the stoking plant according to the invention is constructed as presented and characterized in claim 1, a simple and very reliable bale transport carriage is achieved, and the control of the running of the carriage on a rail element becomes very simple.

The stoking plant according to the invention is preferably constructed as presented and characterized in claim 2, in that this construction is reliable and excludes the possibility of material spilling into the furnace room when a fuel bale is transferred to the bale transport carriage.

By constructing the stoking plant according to the invention as presented and characterized in claim 5, all risk of fire outside the furnaces is eliminated, and all possibilities of false air are avoided, in that the furnace door cannot be opened until the bale transport carriage is securely closed at both ends, namely at the one end by a cover-door and at the other end by the furnace and the furnace door. The furnace door is opened only when this is covered by the closed bale transport carriage.

By further constructing the stoking plant according to the invention as presented and characterized in claim 6, it is avoided that ignited fuel falls out into the bale transport carriage when the stoking element is drawn back. When a bale, for example a bale of straw, is pushed into the furnace, the binding which holds the bale together will break due to the heat, and the bale begins to fall apart. However, the bale holder prevents the fuel from falling back in the bale carriage.

By constructing the stoking plant according to the invention as more closely described and characterized in claim 3, a simple and safe closing and opening of the cover doors is achieved, thus excluding that stoking can take place with an open bale transport carriage.

If the plant according to the invention is constructed as characterized in claim 4, one transport track and one bale transport carriage can be used to supply fuel to, for example, four furnace units. The transport track can be arranged centrally between the furnaces or at the side of one of the furnace lines. Furthermore, apart from the final stretch of 4–8 meters before the slide gate in the closable opening between the fuel store and the furnace room, the transport track can be held at floor level.

Figure 2:
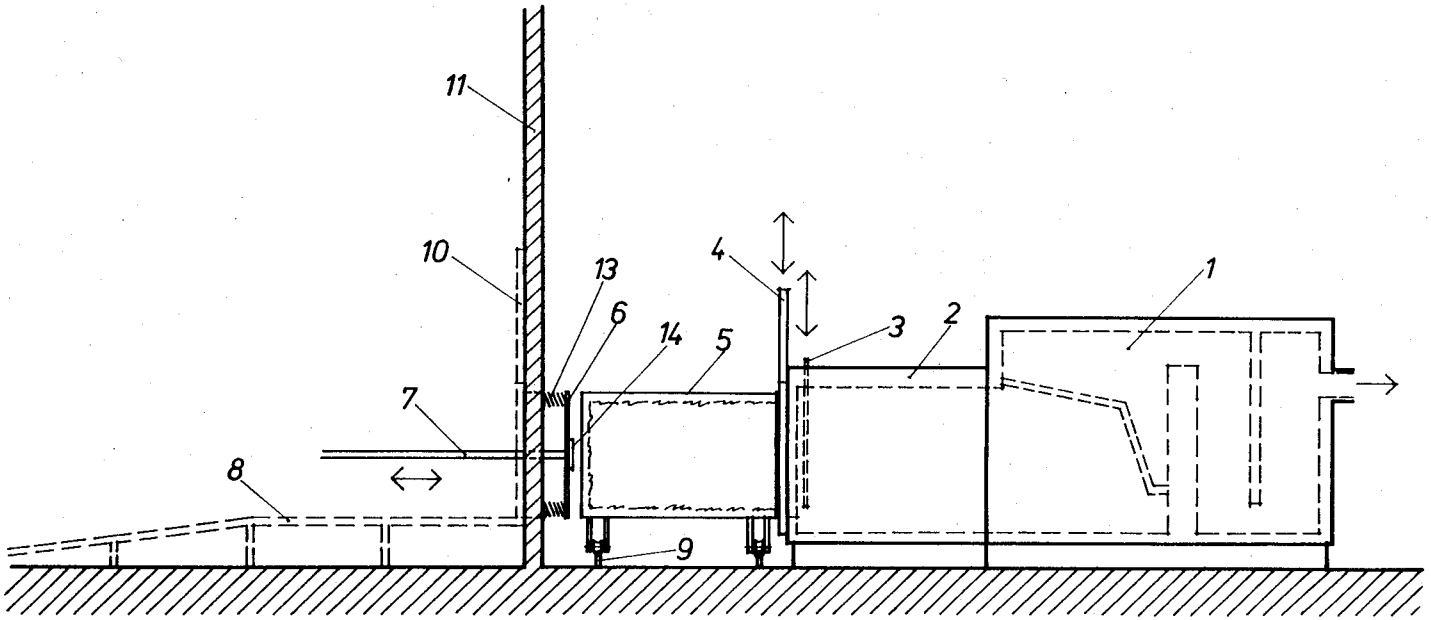
Figure 3:
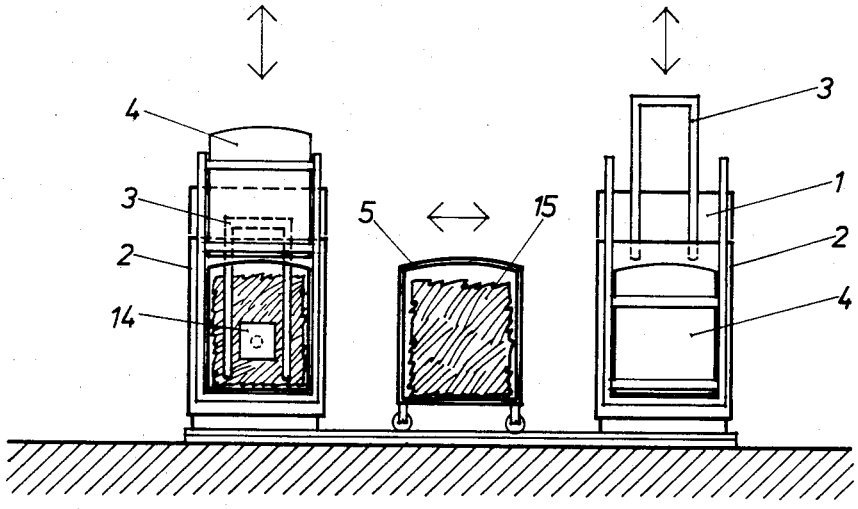

The invention will now be described in closer detail with reference to the drawing, which shows schematically a preferred embodiment of the invention, and where FIG. 1 shows a stoking plant according to the invention, with two furnaces and seen from above, FIG. 2 shows the same as in FIG. 1, but as seen from the side, and FIG. 3 shows the furnaces in FIG. 1 seen in section along the line III—III in FIG. 1

In the drawing, the FIG. 11 indicates a fireproof wall between a fuel store with bales and a transport track 8 for bales on the left-hand side, and a furnace room with two boilers 1, each with a furnace or pre-burner 2, on the right-hand side. The fire wall has an opening which can be closed with a fireproof slide-gate 10.

The bales from the bale store are placed on the transport conveyor 8 by means of a crane or a truck or in another manner. With known means of driving, the transport conveyor feeds the bale forward towards a slide-gate 10 until a desired position controlled by a sensor at the slide-gate 10 is reached. All of the bales are thus still disposed behind a fire wall 11, completely separated from the furnace room.

After stoking (empty carriage), when the bale transport carriage is in position between the slide-gate 10 and a stationary endplate or stop-plate 12, a signal is released for the opening of the slide-gate 10.

When the slide-gate 10 is fully open, a relay is activated to start the transport conveyor 8, which feeds the bale 15 into a bale transport carriage 5. The bale transport carriage 5 is a carriage on rails 9 made of a fireproof material, preferably of iron. The bale transport carriage is in the form of a sluice/tube open at both ends. A conveyor in the bale transport carriage eventually continues the transport of the bale, and when the bale is clear of the fire wall 11, the slide-gate 10 is released and moves into the closed position. The conveyor in the bale transport carriage 5 continues the transport of the bale until it influences the endplate 12, and this results in the conveyor in the bale transport carriage 5 being stopped.

The bale transport carriage can, for example, be provided with a weight cell or another weighing arrangement for ascertainment of the fuel amount.

The bale transport carriage 5 is now filled will fuel and is ready to receive a signal from that oven which is lacking fuel and which is ready to receive fuel. The bale transport carriage is fed forward on the rails 9 to the oven which is lacking fuel, where known automatics ensure that the carriage is positioned opposite the furnace door, which is a sliding door 4, and opposite the cover door 6. The bale transport carriage is thus placed between the cover door 6 and the furnace 2. When the bale transport carriage 5 is in the correct position, the maneuvering ing element 7, which is a hydraulic or pneumatic piston element, is released so much that the springs 13 can press the cover door 6 against the open end of the bale carriage 5.

The pressure of the cover door 6 on the bale transport carriage 5 releases the slide-door 4, which in its fully open condition releases the piston 7 on which there is mounted a push-plate 14, and the bale is fed so far into the furnace that a bale holder 3, see left-hand furnace in FIG. 3, can be moved down to hold the bale unit. When feeding a bale into the furnace, the bale just introduced pushes possible remains from bales introduced earlier forward into the boiler 1.

In FIG. 2 the bale holder 3 is shown in its lowest position where it can hold a bale which has just been stoked, so that the fuel cannot fall out when the bale separates, while in FIG. 3 in the furnace to the left it is shown in its upper position, i.e. the left-hand furnace is ready to receive fuel. The bale holder 3 is in the form of a yoke or a fork which can be moved down behind a newly-stoked bale, in that the distance between the legs of the bale holder is greater than the breadth of the push-plate 14.

When the bale holder 3 is in its lowest position, the piston 7 is released and withdrawn to that position in which it began to feed the bale into the furnace, i.e. the cover door 6 still covers the one end of the bale transport carriage 5. When the piston is in this position, the slide-door 4 on the furnace is released and, when it is in its fully closed position, the bale holder 3 is released, whereupon the piston 7 is released completely so that it can be moved back, taking with it the cover door 6, to the start position as shown in the drawing.

The bale transport carriage 5 is then released and moved back to its start position between the slide gate 10 and the stationary endplate 12, after which a new bale is transferred to the transport carriage so that it is ready as soon as one of the furnaces is once more in need of fuel.

The double arrows in the drawing indicated the directions of movement of the maneuvering element 7, the bale transport carriage 5, the furnace doors 4 and the bale holders 3. The direction of the bale transport on the transport track 8 is also shown with arrows.

The operational control can be effected with generally-known means for automatic control and regulation, for example those employing ordinary relays, scanning elements, photocells and the like.

I claim:

1. Stoking plant for fuel in whole bales, where the bales are conveyed on a transport track from a store and stoked in the whole condition into one of a number of combustion furnaces, characterized in that means are provided for the transfer of bales through a closable opening to a bale transport carriage which is on rails and formed as a tubular sluice open at both ends and arranged for the transport of one bale at a time, and which conveys the fuel forward to the furnace which is in need of fuel, and when the bale transport carriage has reached a predetermined position at the stoking door of the furnace, the transport carriage is closed with a cover door, whereby a switch element is activated, the stoking door is opened and the fuel is stoked, after which the stoking door is closed, the cover door is withdrawn and the bale transport carriage returns to the closable opening to be refilled.

2. Stoking plant according to claim 1 characterized in that the bale transport carriage (5) is provided with a drive motor, preferably an electromotor, and that it is equipped with a conveyor which can continue to transport a bale during the filling up of the carriage, and that this conveyor is provided with an endstop or a stop-plate (12) which blocks the one end of the tubular sluice, and in that the stop-plate is arranged to control the maneuvering of the conveyor in the carriage, and moreover that the bale transport carriage (10) is supplied with power and controlled through one or more collector shoes or a flexible cable.

3. Stoking plant according to claims 1, characterized in that the cover door (6) has an opening for the maneuvering element (7), and in that the maneuvering element's push-plate (14) is arranged to maintain the cover door (6) against an elastic counter-holder (13) when the maneuvering element is in its start position, and in that the maneuvering element (7) is a hydraulically or pneumatically operated cylinder with piston.

4. Stoking plant according to claim 1, characterized in that a bale transport carriage (5) can serve up to four furnaces (2), in that a substantially straight rail element (9) extends along the stoking doors (4) of the furnaces, and in that the bale transport carriage (5) is arranged to be moved sideways on the rail element seen in relation to the openings in the carriage.

5. Stoking plant for fuel in whole bales, where the bales are conveyed on a transparent track from a store and stoked in the whole condition into one of a number of combustion furnaces, characterized in that means are provided for the transfer of the bales through a closable opening to a bale transport carriage which conveys the fuel forward to the furnace which is in need of fuel, and when the bale transport carriage has reached a predetermined position at the stoking door of the furnace, the transport carriage is closed with a cover door, whereby a switch element is activated, the stoking door is opened and the fuel is stoked, after which the stoking door is closed, the cover door is withdrawn and the bale transport carriage returns to the closable opening to be refilled, and wherein each furnace includes one of said cover door for the carriage's opening and wherein said cover door has means for pressing said cover door and thus the carriage against the furnace for the activation of the opening mechanism for the furnace door, and in that the stoking mechanism comprises a stoking element in the form of a push-plate on a manuevering element which is arranged to push a bale from the bale transport carriage into the furnace.

6. Stoking plant according to claim 5, characterized in that each furnace has a bale holder (3) inside the stoking door (4), said bale holder being arranged to hold a newly-stoked bale in place while the maneuvering element (7) with push-plate (14) is withdrawn.

* * * * *

UNITED STATES PATENT AND TRADEMARK OFFICE

CERTIFICATE OF CORRECTION

PATENT NO. : 4,637,327

DATED : 20 January 1987

INVENTOR(S) : Michael L. S. Jørgensen

It is certified that error appears in the above-identified patent and that said Letters Patent is hereby corrected as shown below:

In column 4, line 38, after "maneuvering" delete "ing".

In column 5, line 9, "indicated" should be --indicate--.

In Claim 3, line 1, "claims" should be --claim--.

In Claim 5, line 2, "transparent" should be --transport--.

Signed and Sealed this

Eighth Day of September, 1987

*Attest:*

DONALD J. QUIGG

*Attesting Officer*

*Commissioner of Patents and Trademarks*